United States Patent [19]

Webster

[11] Patent Number: 4,690,357

[45] Date of Patent: Sep. 1, 1987

[54] BAG STAND CONTAINER

[76] Inventor: James N. Webster, R.R. #3, Dundas, Ontario, Canada, L9H 5E3

[21] Appl. No.: 743,413

[22] Filed: Jun. 11, 1985

[51] Int. Cl.[4] ..... B65B 67/04

[52] U.S. Cl. ..... 248/99; 248/97

[58] Field of Search ..... 248/95, 96, 97, 98, 248/99, 100, 101, 176; D34/6; 232/43.1, 43.2, 43.5

[56] References Cited

U.S. PATENT DOCUMENTS

| | | | |
|---|---|---|---|
| D. 142,286 | 8/1945 | Mayer | 248/101 X |
| D. 216,438 | 1/1970 | Gay et al. | D34/6 |
| 1,542,164 | 6/1925 | Nelson | 248/100 X |
| 4,138,139 | 2/1979 | Alfonso | 248/98 X |
| 4,174,085 | 11/1979 | Ferreira et al. | 248/97 |
| 4,588,154 | 5/1986 | Basore | 248/97 X |

*Primary Examiner*—Ramon O. Ramirez

*Attorney, Agent, or Firm*—Christel, Bean & Linihan

[57] ABSTRACT

A free standing frame and lid assembly for supporting plastic garbage bags during filling and containing the odors. The stand consists of a metal frame having a top rectangular section over which the opening of a plastic bag may be stretched, a similar bottom rectangular section which rests on the floor and two vertical legs rigidly connected to the preceeding two sections by a continuation of the same material. The lid is hinged to one side of the top rectangular section of the frame by a circular clip attached to the lid. The continuity of the material in the connections of the top and bottom sections to the legs provides the rigidity to the frame. The stretched bag over the frame opening forms an effective seal with the attached lid.

8 Claims, 5 Drawing Figures

FIG-1
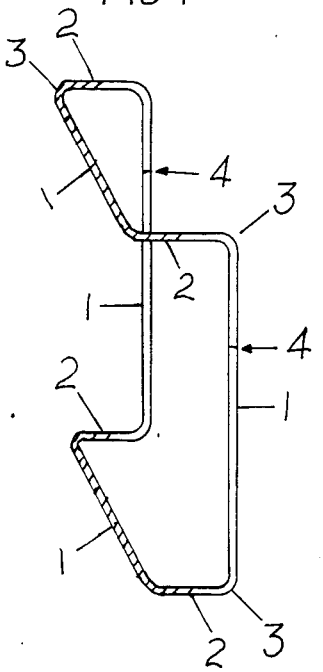
FIG-2
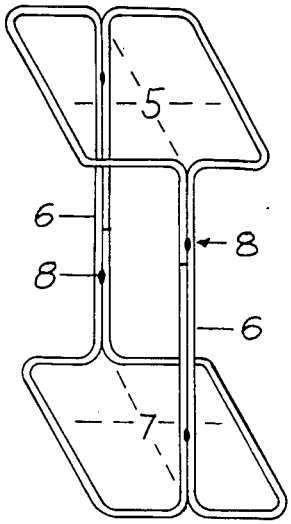
FIG-3
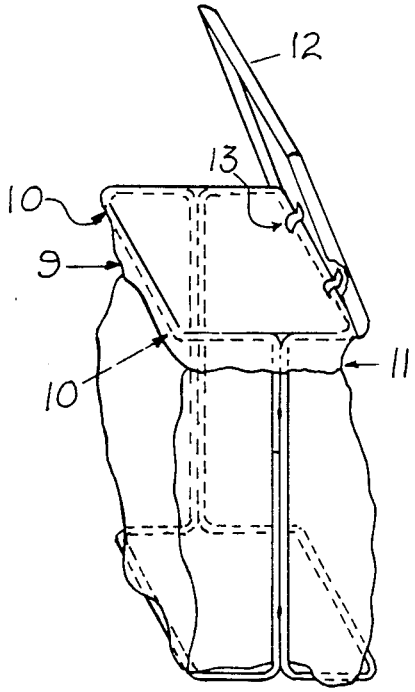
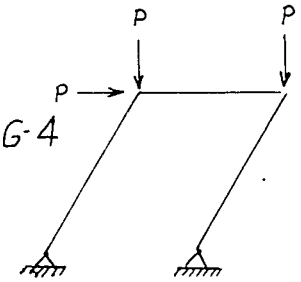
FIG-4
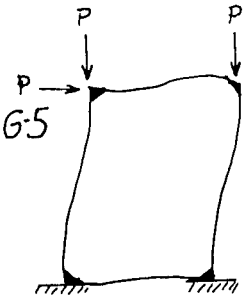
FIG-5

BAG STAND CONTAINER

This invention relates to the support of a plastic garbage bag and the containment of odours.

BACKGROUND OF THE INVENTION

During the process of filling a plastic bag with garbage it is necessary to support the open top of the bag and the weight of the garbage. At present this is performed by various open topped walled containers or frames attached to some form of structural support. An objective of this invention is to provide a frame for supporting an open bag during filling without the necessity of attaching it to any means of support. A further objective is to provide a means of attaching a hinged lid to the frame.

BRIEF SUMMARY

A free standing frame and lid assembly has therefore been developed for supporting plastic garbage bags during filling, which has special advantages of strength, sanitation, and convenience, compared to other types of containers or bag stands. It is known that bag stands of some form have existed through the ages ever since man started to put grain into sacks. It is also known that several bag stands currently exist which require attachment to a wall or post for support or are constructed with relatively heavy materials. The proposed invention however due to the unique form of its continuity of construction is rigid, light in weight and requires no other form of structural support. The bag stand consists of a metal frame having a top rectangular section, over which the opening of a plastic bag may be stretched, a similar bottom rectangular section which rests on the floor, and, two vertical legs rigidly connected to the preceeding two sections by a continuation of the same material. The continuity of the material in the connections of the top and bottom sections to the legs provides the rigidity of the frame. The separation of the two legs at the opposite sides of the frame sections described, provides a means of convenient removal of a filled plastic bag without the necessity of lifting it through a frame or container opening. The frame configuration also provides a hinge pin for an attached lid which, being an integral part, closely seals the container against the escape of odours.

BRIEF DESCRIPTION

FIG. 1. is an isometric view of the "U" shaped section of this invention comprising half the stand.

FIG. 2. is an isometric view of the assembled stand consisting of the two "U" shaped sections joined back to back with tack welds.

FIG. 3. is an isometric view of the assembled stand, attached plastic bag, and attached lid.

FIG. 4. is a schematic representation of a three sided frame under load having semi rigid or non rigid connections at the corner joints depicting other bag stands.

FIG. 5. is a schematic representation of a four sided frame having rigid corner joints when subjected to vertical and lateral loads depicting the proposed bag stand.

DESCRIPTION

The proposed bag stand consists of a two-legged frame configuration made by bending tubular or solid bars into two self-supporting "U" shaped sections, FIG. 1 of accompanying illustration, and attaching said two "U" sections back to back by means of suitable fasteners or welds, FIG. 2, to form a frame stand to which a specific sized bag may be conveniently attached, FIG. 3. Each "U" shaped section consists of two half sections. Each half section includes a straight center piece 1, two parallel side pieces 2, and two parallel back pieces 1*a* connected to each other by smooth radius bends 3 of the same material. The half sections are closed by joining the material ends at joints 4, thus forming the "U" shaped section FIG. 1. The assembly and attachment of said "U" shaped sections in pairs back to back forms a stand, FIG. 2, having a rectangular frame at the top 5 over which the edge of a bag opening may be attached, FIG. 3, two vertical legs 6 attached to the two opposite sides of the said top frame and a similar rectangular frame 7 which rests on the floor and is joined to the two vertical legs by means of continuity of the frame bends as previously described. This continuity in the forming of the "U" bends by means of 90° radius bends 3 and their connection back to back by means of a weld or fastener 8 forms a bag stand having exceptional properties of lightness and strength.

The size of the top rectangular opening 5 and the height of the frame have been designed to suit a specific size of plastic bag—or a cloth bag having a draw string closure.

The perimeter of the opening must be larger than the perimeter of the open bag so that the bag may be held by a short rim 9 stretched over the said rectangular opening. A plastic bag can thus be supported by pockets formed in the plastic at the four corners 10, thus the frame about the top opening is specially sized for this purpose. Cloth bags, if made with a sewn seam and a short vertical split can be supported in a similar manner by folding the seamed edge down over the top rectangular opening and partially tightening the draw string.

In addition to the support of the bag by the size and shape of the top frame described above, the dimensions of the stand are designed so that a specific sized bag when filled will rest on the bottom rectangular opening, as shown in FIG. 3. This weight of a filled bag resting on the bottom rectangular section item 7, stabilizes the attached legs item 6 and thus the frame FIG. 2.

By these principles, the common $1\frac{1}{2}$ mil thick, e.g. $26'' \times 36''$ polyethylene bag may be conveniently filled with garbage and detached from the frame. Also a more substantial cloth bag may be filled with wet laundry and detached in a similar manner. As illustrated in FIG. 3, a hinged lid 12 may be conveniently clipped to the frame by clips 13 utilizing part of the frame for the hinge pin.

ADVANTAGES

The "U" shaped sections when attached back to back form what may be classified by engineers as a rigid frame structure. Such structures which have both ends of the two vertical supporting members rigidly connected to a lateral part of the frame with approximately the same strength are especially suitable to resist side sway and collapse as illustrated by FIG. 5.

A second structural advantage is the attachment of the two said "U" sections in which the two vertical supports act jointly rather than individually in resisting lateral bending.

A third advantage of this configuration is that a major part of the weight of a filled bag rests on the lower rectangular frame which in turn rests on the floor, thus stabilizing the frame.

A fourth advantage is in the easy attachment and securing of the top of the bag around the said top frame opening.

A fifth advantage of the two legged bag stand is in the easy method of bag removal in which filled bags can simply be detached from the top frame, tied and than pulled out from between the two vertical supports without having to lift the bag.

A sixth advantage of the said bag stand is in the easy method of attaching a clip—on lid 12, 13 in which the frame itself forms the hinge pin for the clips.

I claim:

1. A two legged bag stand capable of supporting an open top plastic or cloth bag; said stand comprising two closed U-shaped sections, each U-shaped section consisting of a series of eight straight sections, the ends of which are connected to each other by eight bends of approximately 90°, and means mechanically attaching said U-shaped sections back to back to make a bag stand frame having a top frame portion defining a top generally rectangular opening over which the top of an open bag may be attached, a similarly shaped bottom frame portion resting on the floor, and two vertically support members extending between said top and bottom frame portions.

2. The two legged bag stand as set forth in claim 1 in which the perimeter of the top frame portion is larger than the perimeter of the open top plastic or cloth bag by a minimum of 5% and a maximum of 20%.

3. The two legged bag stand as set forth in claim 2 in which the perimeter of the top rectangular opening is larger than the perimeter of the open top plastic or cloth bag by approximately 8%.

4. The two legged bag stand as set forth in claim 1 in which the top frame portion is provided with rounded corners, the radii of the corners varying from a minimum of one inch to a maximum of three inches.

5. The two legged bag stand as set forth in claim 1 in which the width of the two legged bag stand is adapted to conveniently contain a full bag between the two vertical supports whereby by easy removal of the bag after detachment from the top frame portion is accomplished by sliding it forward from between the vertical supports without having to lift the bag off the floor.

6. The two legged bag stand as set forth in claim 1 in which the height of the vertical support members is so proportioned to the length of the open bag that most of the weight of a full bag when secured to the top frame portion is supported on the floor and only a smaller portion of the weight of the full bag is supported by the top frame portion.

7. The two legged bag stand as set forth in claim 1 further characterized by the provision of a detachable lid provided with two spaced apart clips which may be temporarily attached to one side of the top frame portion by said two clips, said said one side of the top frame portion being utilized as a hinge pin.

8. The two legged bag stand as set forth in claim 1 in which the two closed U-shaped sections are each formed from half sections, each half section in turn including a straight center section, two parallel straight side sections, and two parallel straight back sections, each of the straight sections being connected to an adjacent straight section by a smooth radius bend of the same material.

* * * * *

UNITED STATES PATENT AND TRADEMARK OFFICE

CERTIFICATE OF CORRECTION

PATENT NO. : 4,690,357

DATED : Sep. 1, 1987

INVENTOR(S) : James N. WEBSTER

It is certified that error appears in the above-identified patent and that said Letters Patent is hereby corrected as shown below:

The drawing Figure 1 should read as shown below.

FIG-1

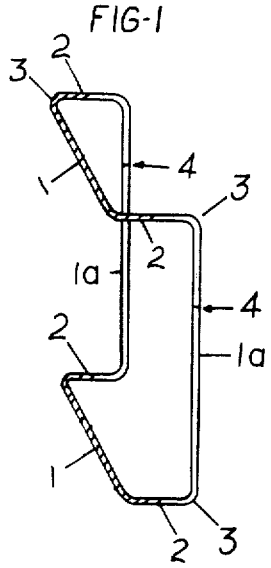

Signed and Sealed this

Twelfth Day of April, 1988

*Attest:*

DONALD J. QUIGG

*Attesting Officer*

*Commissioner of Patents and Trademarks*